US005250081A

United States Patent [19]

Habeeb et al.

[11] Patent Number: 5,250,081

[45] Date of Patent: Oct. 5, 1993

[54] SMOKE REDUCING ADDITIVE FOR TWO-CYCLE ENGINE LUBRICANT-FUEL MIXTURE COMPRISING THE HOFMANN DECOMPOSITION PRODUCTS OF A QUATERNARY AMMONIUM HYDROXIDE

[75] Inventors: Jacob J. Habeeb, Westfield, N.J.; Christopher J. May, Sarnia, Canada

[73] Assignee: Exxon Research & Engineering Company, Florham Park, N.J.

[21] Appl. No.: 926,472

[22] Filed: Aug. 6, 1991

Related U.S. Application Data

[63] Continuation-in-part of Ser. No. 634,836, Dec. 27, 1990, abandoned.

[51] Int. Cl.[5] ..... C10L 1/22

[52] U.S. Cl. ..... 44/422; 44/412; 44/434

[58] Field of Search ..... 44/412, 422, 434

[56] References Cited

U.S. PATENT DOCUMENTS

| | | | |
|---|---|---|---|
| 3,468,640 | 9/1969 | Barusch et al. | 44/422 |
| 4,200,545 | 4/1980 | Clason et al. | 252/33.4 |
| 4,787,916 | 11/1988 | Feldman | 44/422 |
| 4,902,437 | 2/1990 | Vardi et al. | 252/47.5 |

*Primary Examiner*—Jerry D. Johnson
*Attorney, Agent, or Firm*—John W. Ditsler; James H. Takemoto

[57] ABSTRACT

A process for reducing smoke emitted from a two-cycle internal combustion engine wherein the engine is operated with a lubricant oil-fuel mixture containing certain quaternary ammonium hydroxides. A preferred quaternary ammonium hydroxide is tricapryl methyl quaternary ammonium hydroxide.

9 Claims, No Drawings

SMOKE REDUCING ADDITIVE FOR TWO-CYCLE ENGINE LUBRICANT-FUEL MIXTURE COMPRISING THE HOFMANN DECOMPOSITION PRODUCTS OF A QUATERNARY AMMONIUM HYDROXIDE

This is a Continuation-in-Part of U.S. Ser. No. 634,836 filed Dec. 27, 1990, now abandoned.

BACKGROUND OF THE INVENTION

1. Field of the Invention

This invention relates to a process for reducing smoke emitted from two-cycle internal combustion engines. The engine is operated with a lubricant-fuel mixture containing certain quaternary ammonium hydroxides.

2. Description of Related Art

In the last several years, the use of spark-ignited two-cycle internal combustion engines has increased significantly. This is due to their use in a variety of garden and recreational equipment such as motorcycles, marine outboard engines, snowmobiles, power mowers, snow blowers, chain saws, and the like. As such, the amount of smoke released from two-cycle engines has become a major environmental concern to engine manufacturers and fuel suppliers. However, few smoke reducing additives are commercially available, and the few that are contain metals, which are environmentally undesirable.

U.S. Pat. Nos. 4,787,916 and 4,902,437 together with the patents disclosed therein (the disclosures all of which are incorporated herein by reference) describe the use of quaternary ammonium hydroxides in fuels and in lubricating oils, respectively.

However, neither of these patents suggest the particular additive for the two-cycle engine lubricant-fuel mixture disclosed herein or its effectiveness in reducing the smoke formed during combustion of the mixture.

SUMMARY OF THE INVENTION

This invention concerns a process for reducing smoke emitted from a two-cycle engine which comprises:

(1) mixing a distillate fuel with from about 1 to about 3 vol. % of a lubricating oil basestock to produce a fuel-oil mixture (2) adding to the fuel-oil mixture from about 0.1 to about 5 wt. % based on weight of lubricant in the fuel oil mixture of an additive comprising a quaternary ammonium hydroxide having the general formula:

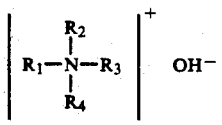

(I)

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, wherein $R_1$, $R_2$, $R_3$, or $R_4$ optionally contains a nitrogen atom, an oxygen atom, a sulfur atom or mixtures thereof, or a mixture of quaternary ammonium hydroxide having the general formula (I) and Hofmann decomposition products thereof, and (3) operating the two-cycle engine with the additive containing fuel-oil mixture.

DETAILED DESCRIPTION OF THE INVENTION

In general, the two-cycle engine lubricant-fuel mixture of this invention requires a lubricating oil basestock, a distillate fuel, and a particular class of quaternary ammonium hydroxides. However, if desired, other lubricant and distillate fuel additives may be present in the mixture as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerylthritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

If desired, other additives known in the art may be added to the lubricating base oil. Such additives include dispersants, anti-wear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

The distillate fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g. methanol, ethanol, diethyl ether, methyl ethyl ether, nitromethane), are also within the scope of this invention as are liquid fuels derived from vegetable or mineral sources such as corn, alfalfa, shale, and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels may also contain other additives which are well known to those skilled in the art. These can include anti-knock agents such as tetra-alkyl lead compounds, lead scavengers such as halo-alkanes (e.g., ethylene dichloride and ethylene dibromide), dyes, cetane improvers, anti-oxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents, and the like. This invention is useful with lead-free as well as lead containing fuels.

The lubricant-fuel mixture will also contain an oil-soluble quaternary ammonium hydroxide having the formula:

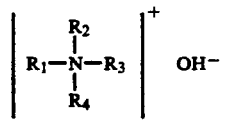

wherein $R_1$ is a hydrocarbon radical (or group) or a hydroxy terminated radical (or group) having from 1 to 24 carbon atoms, $R_2$ is a hydrocarbon radical having from 1 to 24 (preferably from 4 to 24) carbon atoms, and $R_3$ and $R_4$ are hydrocarbon radicals having from 4 to 24 carbon atoms. The hydrocarbon radicals ($R_1$, $R_2$, $R_3$, and $R_4$) can be alkyl groups, unsaturated paraffin groups, cyclic hydrocarbon groups, aryl groups, arylalkyl groups or mixtures thereof. In addition, said groups can be normal, branched, substituted groups or mixtures thereof. The hydrocarbon radicals may also contain other atoms such as nitrogen, oxygen, or sulfur; e.g., in the form of an alcohol, an amine, a ketone, a sulfide, a thiosulfide, and other functionalities.

Quaternary ammonium hydroxides in which the hydrocarbon radical is octyl, dodecyl, decyl, octadecyl, capryl radicals, or their mixtures are preferred. Preferred quaternary ammonium hydroxides are dimethyl dioctadecyl ammonium hydroxide, tetraoctyl ammonium hydroxide, tricaprylmethyl ammonium hydroxide, or mixtures thereof. Tetraoctyl ammonium hydroxide, tricaprylmethyl ammonium hydroxide, or mixtures thereof are especially preferred, with tricaprylmethyl ammonium hydroxide being most preferred.

The quaternary ammonium hydroxides described hereinabove can be readily prepared from their corresponding commercially available quaternary ammonium salt, such as a halide. For example, a quaternary ammonium chloride may be contacted with an anion exchange resin such that the chloride is exchanged to produce the corresponding quaternary ammonium hydroxide.

Quaternary ammonium hydroxides may undergo Hofmann elimination reactions under favorable conditions. It is known that upon heating, quaternary ammonium hydroxides are subject to the Hofmann elimination reaction to yield a tertiary amine, an alkene and water. This is illustrated as follows:

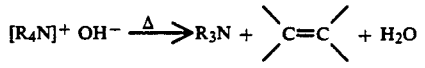

Some quaternary ammonium hydroxides are commercially available in the form of solutions. Evaporation of solvent may lead to the Hofmann reaction described above.

Oil-soluble, as used herein, means that the additive is soluble in the mixture at ambient temperatures, e.g., at least to the extent of about 5 wt. % additive in the mixture at 25° C.

As is well known to those skilled in the art, two-cycle engine lubricating oils are often added directly to the fuel to form a mixture of oil and fuel which is then introduced into the engine cylinder. Such lubricant-fuel blends generally contain per 1 part of oil about 20–250 parts fuel, typically they contain 1 part oil to about 30–100 parts fuel or about 1 to about 3 vol. % of lubricant oil based on fuel.

The amount of additive in the mixture can vary broadly depending on the lubricant-fuel mixture ratio. Accordingly, only an amount effective in reducing the smoke point of the mixture need be added. In practice, however, the amount of additive added will range from about 0.1 to about 5, preferably from about 0.5 to about 1 wt. %, based on weight of lubricant in the lubricant-fuel mixture.

The invention will be further understood by reference to the following Example, which includes a preferred embodiment of the invention.

EXAMPLE 1

Three samples of the same lubricant-fuel mixture were tested in a single cylinder Yamaha snowmobile engine to determine the maximum smoke produced by each sample. The mixture comprised a commercially available two-cycle engine lubricating oil and a commercially available unleaded gasoline having an RON of 91 and an oil to fuel ratio of 1 to 33. The samples tested were the lubricant-fuel mixture without additives, the mixture with a conventional smoke reducing additive (barium sulfonate), and the mixture with an additive of this invention (TCMAH=tricapryl methyl ammonium hydroxide). The maximum smoke produced when operating the engine at 4500 rpm and applying a 10 Nm (Newton meter) load was measured by inserting an optical opacity smokemeter into the exhaust system. The results obtained are shown in Table 1 below.

TABLE 1

| Test No. | Additive | Conc, wt. % | Max. Smoke, % | Smoke Reduction, % |
|---|---|---|---|---|
| 1 | None | — | 49.6 | — |
| 2 | TCMAH | 1.0 | 37.6 | 24 |
| 3 | Ba Sulfonate | 1.0 | 39.8 | 20 |

The data in Table 1 show that the additives of this invention provide a reduction in smoke comparable with that of barium sulfonate (a commercially available additive) without the formation of ash.

EXAMPLE 2

TCMAH is commercially available as a 50% solution in methanol. Concentrated TCMAH was obtained by roto evaporating the commercially available solution at 40° C. for 9 hours. Analysis of the concentrated TCMAH by $^{13}$C-NMR gave the results shown in Table 2.

TABLE 2

| Compound | % Weight Fractions |
|---|---|
| Methanol | 3.3 |
| TCMAH | 18.8 |
| Trialkylamine | 6.7 |
| Methyldialkylamine | 66.8 |
| Primary Olefin | 4.4 |

The analysis indicates that TCMAH undergoes partial decomposition by the Hoffman elimination reaction. Nevertheless, Example 1 demonstrates that the TCMAH concentrate reduces smoke emitted from two-cycle engines.

What is claimed:

1. A process for reducing smoke emitted from a two-cycle engine which comprises:
   (1) mixing a distillate fuel with from about 1 to about 3 vol. % of a lubricating oil basestock to produce a fuel-oil mixture
   (2) heating a quaternary ammonium hydroxide having the general formula:

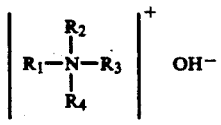

(I)

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, wherein $R_1$, $R_2$, $R_3$, or $R_4$ optionally contains a nitrogen atom, an oxygen atom, a sulfur atom or mixtures thereof, or a mixture of quaternary ammonium hydroxide having the general formula (I) to a temperature sufficient to decompose said quarternary ammonium hydroxide to the Hofmann decomposition products thereof,
   (3) adding to the fuel-oil mixture from about 0.1 to about 5 wt. % based on weight of lubricant in the fuel-oil mixture of an additive comprising the Hofmann decomposition products of the quarternary ammonium hydroxide, and
   (4) operating the two-cycle engine with the additive containing fuel-oil mixture.

2. The process of claim 1 wherein $R_2$ has from 4 to 24 carbon atoms.

3. The process of claim 1 wherein $R_1$, $R_2$, $R_3$, or $R_4$ is a normal, branched or substituted alkyl group, unsaturated paraffin group, cyclic hydrocarbon group, aryl group, arylalkyl group, or mixtures thereof.

4. The process of claim 1 wherein $R_1$, $R_2$, $R_3$, $R_4$, or mixtures thereof is selected from the group consisting of octyl, dodecyl, decyl, octadecyl, capryl radicals, and mixtures thereof.

5. The process of claim 1 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

6. The process of claim 5 wherein the quaternary ammonium hydroxide comprises tricapryl methyl ammonium hydroxide.

7. The process of claim 1 wherein $R_1$, $R_2$, $R_3$, $R_4$, or mixtures thereof also contains a nitrogen atom, an oxygen atom, a sulfur atom, or mixtures thereof.

8. The process of claim 1 wherein the fuel is gasoline.

9. The process of claim 1 wherein the Hofmann decomposition products contain olefins and tertiary amines having the formula $R_1R_3R_4N$, $R_2R_3R_4N$ or mixtures thereof wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, wherein $R_1$, $R_2$, $R_3$, or $R_4$ optionally contains a nitrogen atom, an oxygen atom, a sulfur atom or mixtures thereof.

* * * * *